US010154772B2

(12) United States Patent
Feddema

(10) Patent No.: US 10,154,772 B2
(45) Date of Patent: Dec. 18, 2018

(54) SPRAY ARM FOR A DISH TREATING APPLIANCE

(71) Applicant: WHIRLPOOL CORPORATION, Benton Harbor, MI (US)

(72) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 482 days.

(21) Appl. No.: 14/953,822

(22) Filed: Nov. 30, 2015

(65) Prior Publication Data

US 2017/0150866 A1 Jun. 1, 2017

(51) Int. Cl.

| | |
|---|---|
| ***A47L 15/42*** | (2006.01) |
| ***B05B 3/00*** | (2006.01) |
| ***B05B 3/06*** | (2006.01) |
| ***A47L 15/23*** | (2006.01) |

(52) U.S. Cl.

CPC ..... *A47L 15/23* (2013.01); *B05B 3/003* (2013.01); *B05B 3/06* (2013.01)

(58) Field of Classification Search

CPC ..... A47L 15/4214; B05B 3/003; B05B 3/06

USPC ..... 134/56 D, 57 D, 58 D, 176

See application file for complete search history.

(56) References Cited

U.S. PATENT DOCUMENTS

| | | | | |
|---|---|---|---|---|
| 5,464,482 | A | 11/1995 | Michael et al. | |
| 5,579,789 | A | 12/1996 | Spiegel | |
| 2010/0043825 | A1* | 2/2010 | Bertsch | A47L 15/23 134/18 |

FOREIGN PATENT DOCUMENTS

| | | |
|---|---|---|
| CN | 204158346 U | 2/2015 |

* cited by examiner

*Primary Examiner* — Levon J Shahinian
(74) *Attorney, Agent, or Firm* — McGarry Bair PC

(57) ABSTRACT

A dish treating appliance includes a tub having an access opening and at least partially defining a dish treating chamber a rotating spray arm having multiple spray nozzles and a first supply conduit fluidly coupled to the multiple spray nozzles, and a manifold supplying liquid to the first and second supply conduits, wherein the supply of liquid from the manifold to the first supply conduits causes liquid to be emitted from the multiple spray nozzles into the treating chamber.

17 Claims, 5 Drawing Sheets

SPRAY ARM FOR A DISH TREATING APPLIANCE

BACKGROUND OF THE INVENTION

Contemporary automatic dishwashers for use in a typical household include a tub and at least one rack or basket for supporting soiled dishes within the tub. A spraying system can be provided for recirculating liquid throughout the tub to remove soils from the dishes. The spraying system can include various sprayers including a rotatable spray arm. The sprayers have multiple nozzles or openings through which spray is emitted. The rotatable spray arm is rotationally driven by the emitted spray from nozzles or openings, often called drive nozzles or drive openings, which are located near the ends of the arm and oriented so that the emitted liquid imparts a rotational force to the arm.

SUMMARY

In one embodiment of the disclosure, a dish treating appliance includes a tub having an access opening and at least partially defining a dish treating chamber, a first rotating spray arm having multiple drive nozzles and a second supply conduit fluidly coupled to the multiple drive nozzles, a second rotating spray arm having multiple spray nozzles and a first supply conduit fluidly coupled to the multiple spray nozzles, a manifold supplying liquid to the first and second supply conduits, and a gear drive rotationally coupling the first and second rotating spray arms such that rotation of the first rotating spray arm rotates the second rotating spray arm. The supply of liquid from the manifold to the first and second supply conduits causes liquid to be emitted from the multiple spray nozzles into the treating chamber and liquid to be emitted from the drive nozzles to rotate the first rotating spray arm, which drives the gear drive to rotate the second rotating spray arm.

In another embodiment of the disclosure, a spray arm assembly includes a first rotating spray arm having multiple drive nozzles and a second supply conduit fluidly coupled to the multiple drive nozzles, a second rotating spray arm having multiple spray nozzles and a first supply conduit fluidly coupled to the multiple spray nozzles, a manifold supplying liquid to the first and second supply conduits, and a gear drive rotationally coupling the first and second rotating spray arms such that rotation of the second rotating spray arm rotates the first rotating spray arm. The supply of liquid from the manifold to the first and second supply conduits causes liquid to be emitted from the multiple spray nozzles and liquid to be emitted from the drive nozzles to rotate the second rotating spray arm, which drives the gear drive to rotate the first rotating spray arm.

In yet another embodiment of the disclosure, a spray arm assembly for an appliance performing a cycle of operation on an article includes a manifold supported by the appliance and configured to provide a supply of liquid, a first spray arm rotatably coupled with the manifold and having a drive nozzle and a first gear, wherein the first spray arm is configured to receive at least a first portion of the liquid and provide at least the first portion of the liquid to the drive nozzle, and a second spray arm rotatably coupled with the manifold and having a set of spray heads and a second gear, wherein the second spray arm is configured to receive at least a second portion of the liquid, provide at least the second portion of the liquid to the set of spray heads, and wherein the second gear meshes with the first gear. The providing of the first portion of the liquid through the drive nozzle drives a rotation of the first spray arm, and the rotation of the first spray arm drives the rotation of the second spray arm by way of the first and second gear mesh.

DESCRIPTION OF EMBODIMENTS OF THE INVENTION

Figure 1:
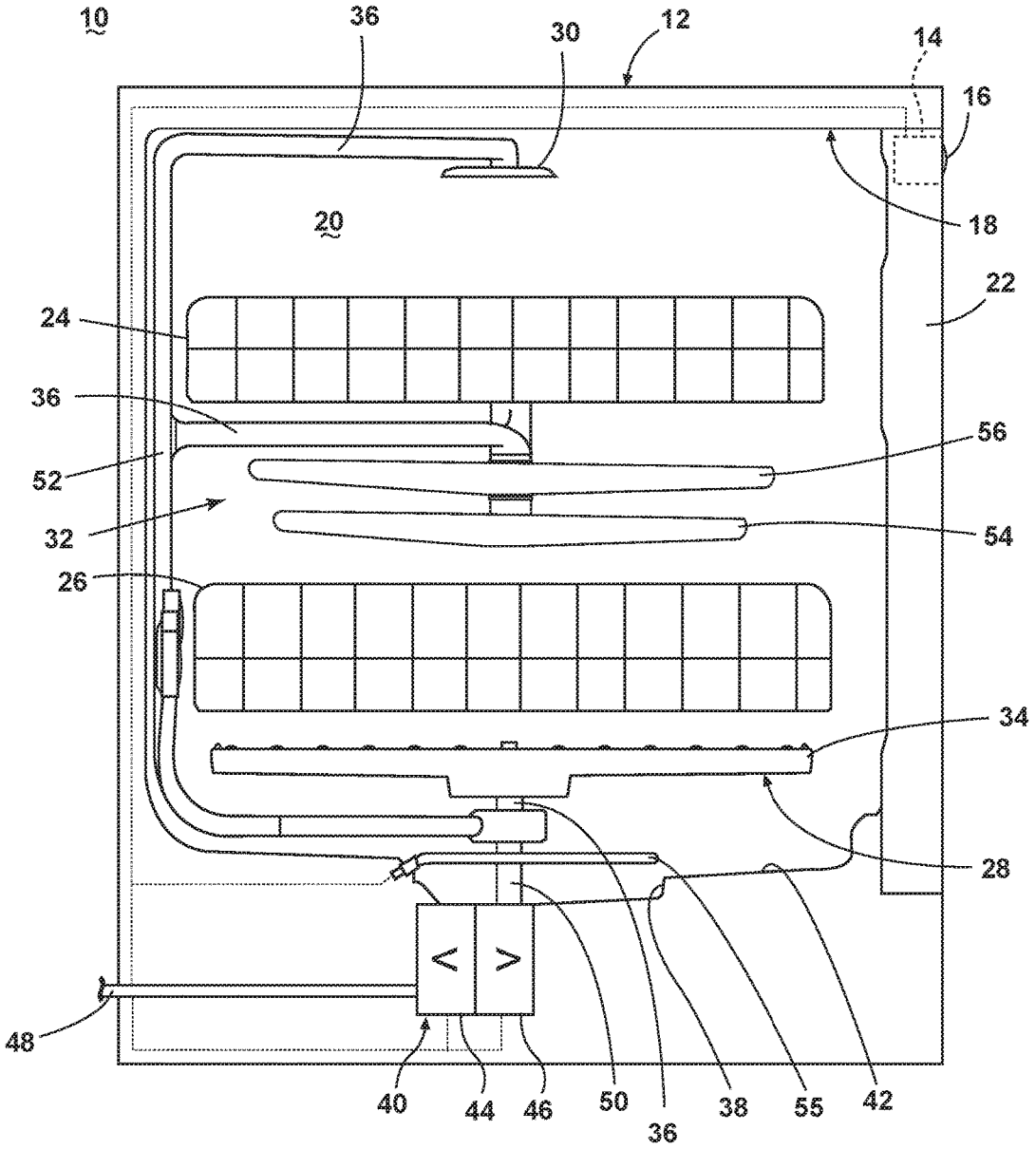
FIG. 1 is a schematic view of a dishwasher with a spray system.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 can be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 can be located within the cabinet 12 and can be operably coupled with various components of the dishwasher 10 to implement one or more cycles of operation. A control panel or user interface 16 can be provided on the dishwasher 10 and coupled with the controller 14. The user interface 16 can include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, can be hingedly mounted to the cabinet 12 and can move between an opened position, wherein the user can access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that can be treated in the dishwasher 10, including, without limitation; dishes, plates, pots, bowls, pans, glassware, and silverware. While not shown, additional dish holders, such as a silverware basket on the interior of the door 22, can also be provided.

A spraying system 28 can be provided for spraying liquid into the treating chamber 20 and is illustrated in the form of an upper sprayer system 30, a mid-level spray system 32, and a lower sprayer system 34. The upper sprayer system 30 can be located above the upper rack 24 and is illustrated as a fixed spray nozzle that sprays liquid downwardly within the treating chamber 20. The upper sprayer system 30 can include or be supported by a spray arm manifold 36 coupled with and supported by the dishwasher 10 or appliance, and configured to provide a supply of liquid for spraying via the sprayer system 30. The lower sprayer system 34 can include or be supported by a spray arm manifold 36 coupled with and supported by the dishwasher 10 or appliance and configured to provide a supply of liquid for spraying via the lower sprayer system 34. As illustrated, the upper sprayer system 30 can be located above the upper rack 24, and the lower sprayer system 34 can be located below the lower rack 26.

The mid-level rotatable spray system 32 can be located beneath the upper rack 24 or above the lower rack 26, or between the adjacent racks 24, 26, and can include a first rotatable spray arm 54 and a second rotatable spray arm 56. Each spray arm 54, 56 can be rotatably coupled with a spray arm manifold 36, and configured in a stacked configuration such that the first and second rotatable spray arms 54, 56 can share a common axis of rotation about the manifold 36. In one example configuration illustrated, the second rotatable spray arm 56 can be rotatably coupled with or supported by the spray arm manifold 36, while the first rotatable spray arm 54 can be positioned adjacent to the second arm 56, opposite of the manifold 36. In this sense, the first rotatable spray arm 54 can be rotatably coupled with or supported by at least one of the second rotatable spray arm 56 or the spray arm manifold 36, and can be located closer to the bottom wall 42 of the tub 18 than the second rotatable spray arm 56. The spray arm manifold 36 can additionally be coupled with and supported by the dishwasher 10 or appliance, and configured to provide a supply of liquid for spraying via at least one of the first or second rotatable spray arms 54, 56.

The upper sprayer system 30 can provide a liquid spray downwardly through the top of the upper rack 24. The mid-level spray system 32 can provide a liquid spray upwardly through the bottom of the upper rack 24. The lower rotatable spray arm system 34 can provide a liquid spray upwardly through the bottom of the lower rack 26. The mid-level spray system 32 can optionally also provide a liquid spray downwardly onto the lower rack 26, but for purposes of simplification, this will not be illustrated herein.

A liquid recirculation system can be provided for recirculating liquid from the treating chamber 20 to the spraying system 28. The recirculation system can include a sump 38 and a pump assembly 40. The sump 38 collects the liquid sprayed in the treating chamber 20 and can be formed by a sloped or recessed portion of the bottom wall 42 of the tub 18. The pump assembly 40 can include both a drain pump 44 and a recirculation pump 46.

The drain pump 44 can draw liquid from the sump 38 and pump the liquid out of the dishwasher 10 to a household drain line 48. The recirculation pump 46 can draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 can include a single pump configured to selectively supply wash liquid to either the spraying system 28 or the drain line 48, such as by configuring the pump to rotate in opposite directions, or by providing a suitable valve system. While not shown, a liquid supply system can include a water supply conduit coupled with a household water supply for supplying water to the sump 38.

As shown herein, the recirculation pump 46 has an outlet conduit 50 in fluid communication with the spraying system 28 or spray arm manifolds 36 for discharging wash liquid from the recirculation pump 46 to the sprayer systems 30-34. As illustrated, liquid can be supplied to the spray arm manifolds 36, mid-level rotatable spray system 32, lower sprayer system 34, and upper sprayer system 30 through a supply tube 52 that extends generally rearward from the recirculation pump 46 and upwardly along a rear wall of the tub 18. Further, diverters can be provided within the spraying system 28 such that liquid can be selectively supplied to a subset of the sprayer systems 30-34. The sprayer systems 30-34 spray water or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 55 can be located within or near the sump 38 for heating liquid contained in the sump 38. A filtering system can be fluidly coupled with the recirculation flow path for filtering the recirculated liquid.

Figure 2:
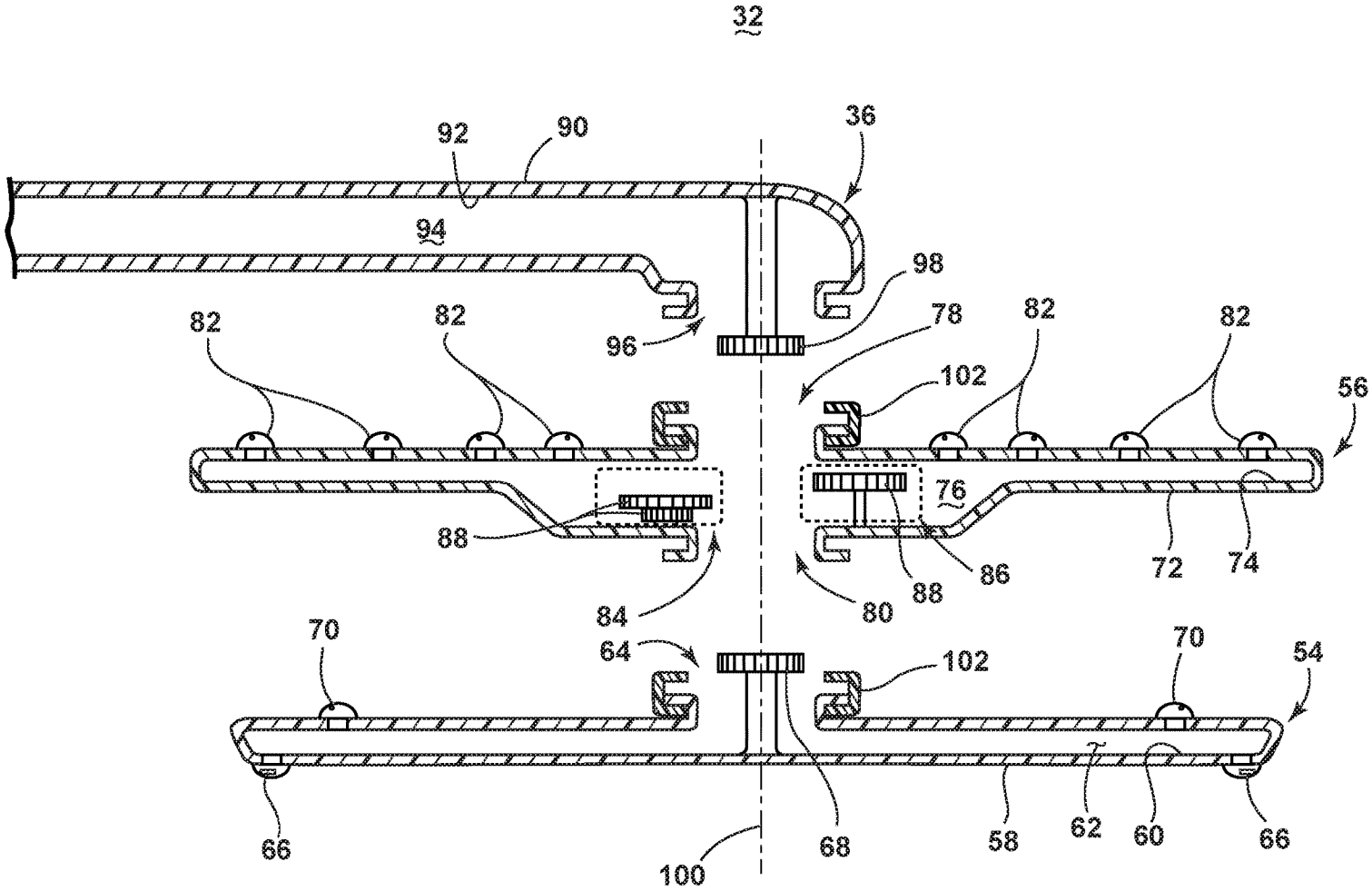
FIG. 2 is a cross-sectional view of a spray system having a first rotatable spray arm and a second rotatable spray arm of the dishwasher of FIG. 1.

FIG. 2 illustrates a cross-sectional exploded view of the mid-level spray system 32, which includes dual rotatable spray arms 54 and 56. The first rotatable spray arm 54 primarily performs a driving function while the second rotatable spray arm 56 primarily performs a spraying function. The first rotatable spray arm 54 is rotatably coupled such that rotation of the first spray arm 54 rotates the second spray arm 56. It is contemplated that the rotating spray arms 54, 56 will rotate at different speeds, with the first rotatable spray arm 54 rotating faster than the second rotating spray arm 56. The spray arms 54 and 56 can rotate in the same direction or can rotate in different directions.

Looking at the spray arms in greater detail, the first rotatable spray arm 54 can include a body 58 having an interior 60. A liquid passage 62 or supply conduit can be defined by or provided in the interior 60 and fluidly couples with at least one of the outlet conduit 50, the recirculation pump 46, the supply tube 52, or the spray arm manifold 36 by way of an opening 64. The first rotatable spray arm 54 can further include a set of drive nozzles 66 fluidly coupled with the liquid passage 62. The first rotatable spray arm 54 can also include a primary gear 68 fixedly coupled with the arm 54 such that the arm 54 and gear 68 co-rotate. As shown, the first rotatable spray arm 54 can also include an optional set of spray nozzles 70, however embodiments of the disclosure can include configurations wherein the spray arm 54 does not include spray nozzles 70. While the embodiment shown locates the drive nozzles 66 on a lower or downward-facing surface of the body 58 and the optional spray nozzles 70 on an upper or upward-facing surface of the body 58, alternative embodiments can include different relative body 58 placement, including co-locating drive and spray nozzles 66, 70 on the same body 58 surface.

The second rotatable spray arm 56 can also include a body 72 having an interior 74 defining or providing a liquid passage 76 or supply conduit fluidly coupled with at least one of the outlet conduit 50, the recirculation pump 46, the supply tube 52, or the spray arm manifold 36 by way of a first opening 78, and further fluidly coupled with the first rotatable spray arm 54 by way of a second opening 80. The second rotatable spray arm 56 can include a set of spray nozzles 82 fluidly coupled with the liquid passage 76. The second rotatable spray arm 56 can also include a secondary gear set 84 and a tertiary gear set 86. The set of spray nozzles 82 of the second rotatable spray arm 56 can include the same or different nozzles 82 as the optional spray nozzles 70 of the first rotatable spray arm 54. As illustrated, the second rotatable spray arm 56 can be configured such that it does not include drive nozzles 66.

The secondary gear set 84 can include multiple gears 88, wherein at least one of the multiple gears is configured to mesh with or be rotatably driven by the primary gear 68 of the first rotatable spray arm 54. In one example, the secondary gear set 84 can include multiple gears 88 configured in a speed-reducing gear set or forming a reduction gear assembly or speed reducer gear drive. Embodiments of the disclosure can include a reduction gear assembly providing, for example, a 4:1 gear reduction relative to the primary gear 68 of the first rotatable arm 54. Stated another way, when the primary gear 68 and the secondary gear set 84 are meshed, the forty revolutions of the primary gear 68 will result in one revolution of at least one of the multiple gears 88 of the secondary gear set 84. The gear reduction ratio can also be selected to aid in allowing the hydraulic drive nozzles 66 to accelerate to or maintain a rotational speed of the first rotatable spray arm 54. Additional gear set configurations and speed-reducing gear sets can be included. Additionally, while two gears 88 have been illustrated in the secondary gear set 84, additional gears 88 can be include.

The tertiary gear set 86 can include at least one gear 88, and can also include a speed-reducing or gear reduction configuration, as explained herein.

The spray arm manifold 36 can include a body 90 having an interior 92 providing a liquid passage 94 or supply conduit fluidly coupled with at least one of the outlet conduit 50, the recirculation pump 46, or the supply tube 52 by way of an opening 96. The spray arm manifold 36 can also include a stationary gear 98 fixedly coupled with the manifold. The stationary gear 98 can be configured to mesh with the tertiary gear set 86 of the second rotatable spray arm 56. As shown, each opening 64, 78, 80, 96 is aligned with a common axis of rotation 100 of the first and second rotatable spray arms 54, 56.

Figure 3:
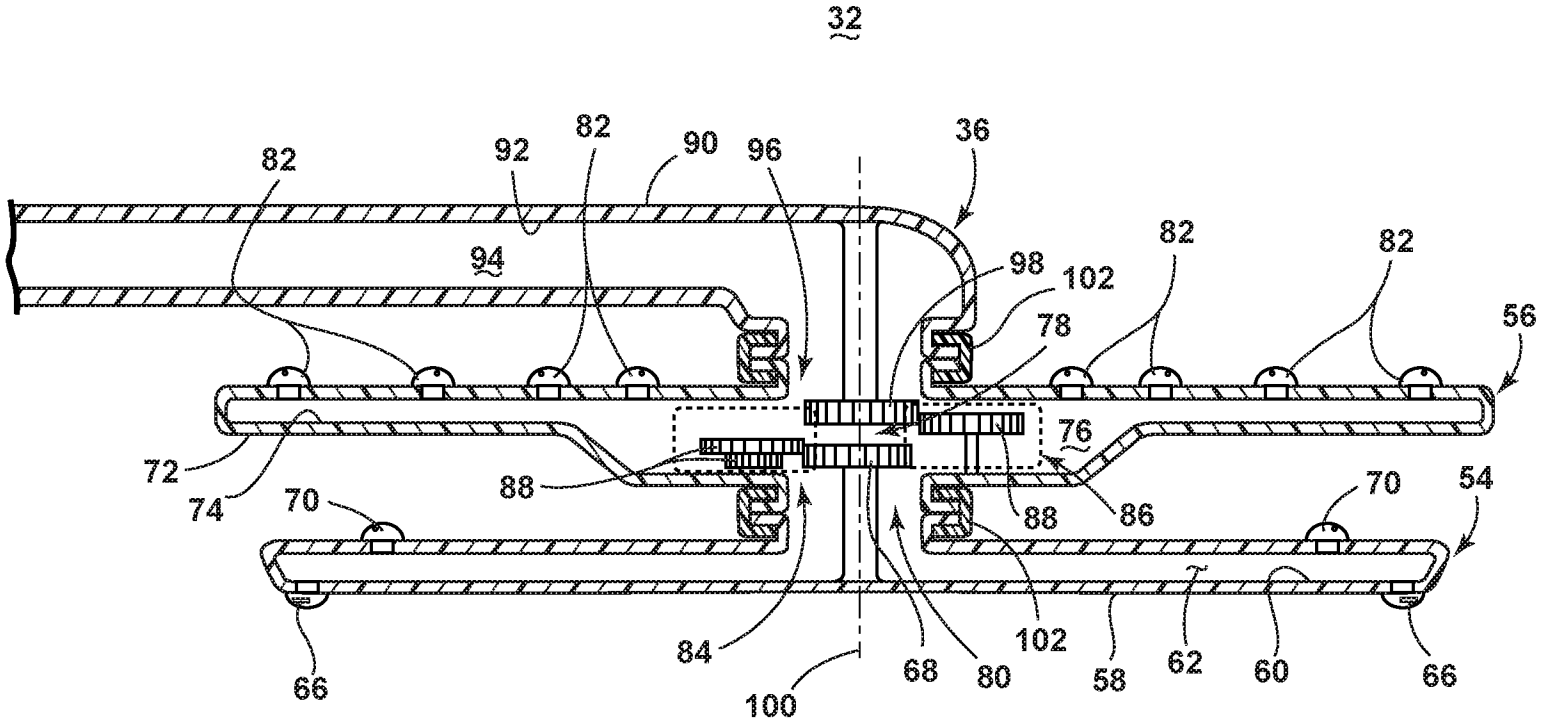
FIG. 3 is a cross-sectional view of the assembled rotatable spray arm assembly of FIG. 2.

FIG. 3 illustrates an assembled mid-level spray system 32, wherein the first rotatable spray arm 54 is mounted to the second rotatable spray arm 56 and the second rotatable spray arm 56 is mounted with the spray arm manifold 36. The spray arm manifold 36 and second rotatable spray arm 56 are configured to be mounted with one another at the opening 96 of the manifold 36 and the first opening 78 of the arm 56. Similarly, the first rotatable spray arm 54 and the second rotatable spray arm 56 are configured to be mounted with one another at the opening 64 and the second opening 80, respectively. When the mid-level spray system 32 is assembled, the mountings between the spray arm manifold 36 and the second rotatable spray arm 56, and between the first rotatable spray arm 54 and the second rotatable spray arm 56, can include a fluid-tight coupling, such as a mechanical coupling, that allows rotation of the spray arms 54, 56, relative to each other, and relative to the manifold 36. In the illustrated embodiment, the mounting or couplings are shown as lock nuts 102.

In this sense, the first and second rotatable spray arms 54, 56 can be directly rotationally mounted to each other. Also shown, the primary gear 68 is shown meshing with the secondary gear set 84 and the stationary gear 98 is shown meshing with the tertiary gear set 86. Collectively, the set of gears 68, 84, 86, 94 can form a gear drive. As illustrated, at least a portion of the gear meshing is located within the liquid passage 76 of the second rotatable spray arm 56, however alternative configurations can be included wherein at least one of the gear meshings is located in the liquid passage 94 of the spray arm manifold 36 or the liquid passage 62 of the first rotatable spray arm 54. The mounting of the first rotatable spray arm 54 to the second rotatable spray arm 56, and of the second rotatable spray arm 56 to the spray arm manifold 36 can define a common fluid passage between the previously described fluid passages 62, 76, 94 of each component 36, 54, 56. In this sense, fluid provided by at least one of the outlet conduit 50, the recirculation pump 46, or the supply tube 52 can be delivered to the interiors 60, 74 of the first and second rotatable spray arms 54, 56 via the manifold 36.

The drive nozzles 66 are configured to provide a source of rotational force for the first rotational arm 54 when a liquid is supplied to the liquid passage 62. In this sense, the multiple drive nozzles 66 provide a hydraulic source of rotational force about the axis of rotation 100 as liquid traverses through the opening 64, through the liquid passage 62, and out of the nozzles 66. The spray nozzles 70, 82, conversely can be configured to provide different spray patterns for liquid traversing the respective liquid passages 62, 76, although this need not be the case. It is advantageous to do so to provide for different cleaning effects by the spray arms 54, 56. For example, a subset of spray nozzles 70, 82 can emit a first liquid spray pattern, which can include a discrete, focused, and concentrated spray, which can provide a higher speed spray. A different subset of spray nozzles 70, 82 can emit a second spray pattern, which can include a wide angle diffused spray pattern that produces more of a shower, in contrast to the more concentrated and discrete spray pattern. The shower spray can be more suitable for distributing treating chemistry whereas the higher pressure spray can be more suitable for dislodging soils. It is contemplated that the spray nozzles 70, 82 can be arranged differently such that the various nozzle 70, 82 types are distributed over the spray arms 54, 56.

Figure 4:
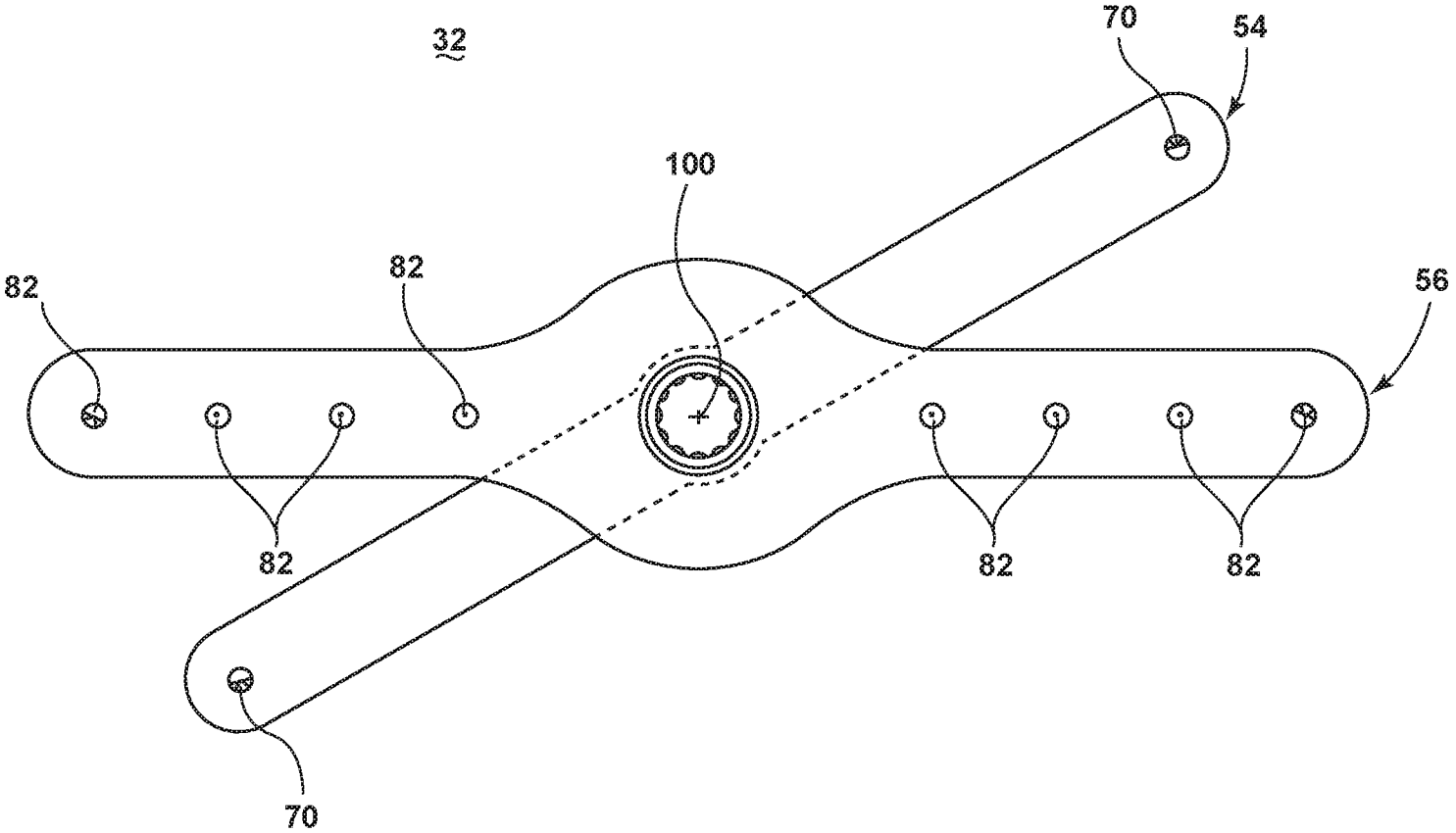
FIG. 4 is a top view of the spray arm assembly of FIG. 2.

FIG. 4 illustrates a top-down view of an example embodiment of the first and second rotatable spray arms 54, 56. While the length of the first rotatable spray arm 54 is shown shorter than the second rotatable spray arm 56, embodiments of the disclosure can be included wherein the first arm 54 is longer than the second arm 56, or wherein the dual arms 54, 56 are substantially equal in length. Additionally, alternative configurations of arms can be included, such as wherein at least one of the first rotatable spray arm 54 or second rotatable spray arm 56 includes a rotatable circular structure, of wherein at least one of the arms 54, 56 includes additional or fewer arms (e.g. one arm, three arms, four arms in an "cross" pattern, etc.).

During operation, a user can initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation can include one or more of the following steps: a wash step, a rinse step, and a drying step. The wash step can further include a pre-wash step and a main wash step. The rinse step can also include multiple steps such as one or more additional rinsing steps performed in addition to a first rinsing. During such cycles, liquid, such as wash fluid, water, or treating chemistry (i.e., water or detergents, enzymes, surfactants, and other cleaning or conditioning chemistry) passes from the recirculation pump 46 into the spraying system 28 and then exits the spraying system through the sprayer systems 30-34.

A supply of liquid supplied by the spray arm manifold 36 to the liquid passage 62 of the first rotatable spray arm 54 can be provided to the multiple drive nozzles 66 can cause the liquid to be emitted from the drive nozzles 66, creating a hydraulic rotational force that causes the rotation of the first rotatable spray arm 54. The supply of liquid supplied can further cause the liquid to be emitted from the optional spray nozzles 70, if provided. The primary gear 68 co-rotates with the first rotatable spray arm 54, and meshes with the secondary gear set 84 of the second rotatable spray arm 56, in turn causing the rotation of the second rotatable spray arm 56. As the second rotatable spray arm 56 is rotated about the axis of rotation 100, the supply of liquid provided by the spray arm manifold 36 is further delivered to the liquid passage 76 of the spray arm 56, which causes the liquid to be emitted from the multiple spray nozzles 82 into the treating chamber.

The rotation of the second rotatable spray arm 56 can further be configured to rotate the tertiary gear set 86 relative to the stationary gear 98, which for example, can further aid in the rotation of at least one of the first rotatable spray arm 54 or the second rotatable spray arm 56 about the spray arm manifold 36. Alternatively, the rotation of the tertiary gear set 86 relative to the stationary gear 98 can be utilized to drive additional mechanical components or spray patterns of the spray nozzles 82. As previously described, the meshing of the primary gear 68 with the secondary gear set 84 can define a reducing gear drive, drive train, or gear set rotationally coupling the first and second rotating spray arms 54, 56 such that the second rotatable spray arm 56 rotates at a slower rotational speed compared with the first rotatable spray arm 54. Embodiments of the disclosure can include examples wherein the tertiary gear set 86 and the stationary gear 98 mesh with or are driven by the primary gear 68, and are included in the reducing gear drive or gear set.

The first and second rotatable spray arms 54, 56, the spray nozzles 70, 82, or the drive nozzles 66 can be configured to operate in response to a known or predetermined supply of liquid. For instance, embodiments of the disclosure can be configured such that the first rotatable spray arm 54 rotates at least at 15 rotations per minute (RPM) to avoid rotational stalling of the movement, or can be configured to reach a target rotational speed of 40 RPM, in response to the spray arm manifold 36 supplying liquid at 20 to 40 liter per minutes. The first rotatable spray arm 54 can be configured to rotate fast enough to prevent stalling, for example, due to friction of the rotating system, such as friction between the first and second rotatable spray arms 54, 56 at the lock nut 102, or due to the gear drive interaction. Likewise, the second rotatable spray arm 56 can be configured to rotate at a speed less than 7 RPM, in response to the rotational speed of the first rotatable spray arm 54, for example to increase the dwell time of the spray nozzle or spray liquid, relative to the dishes. While example rotational speeds are provided for the first and second rotational spray arms 54, 56, alternative configurations can be included to alter, adjust, or match alternate target rotational speeds of at least one arm 54, 56. Likewise arm 54 and 56 could rotated different directions to provide coverage of dish items from both directions.

Figure 5:
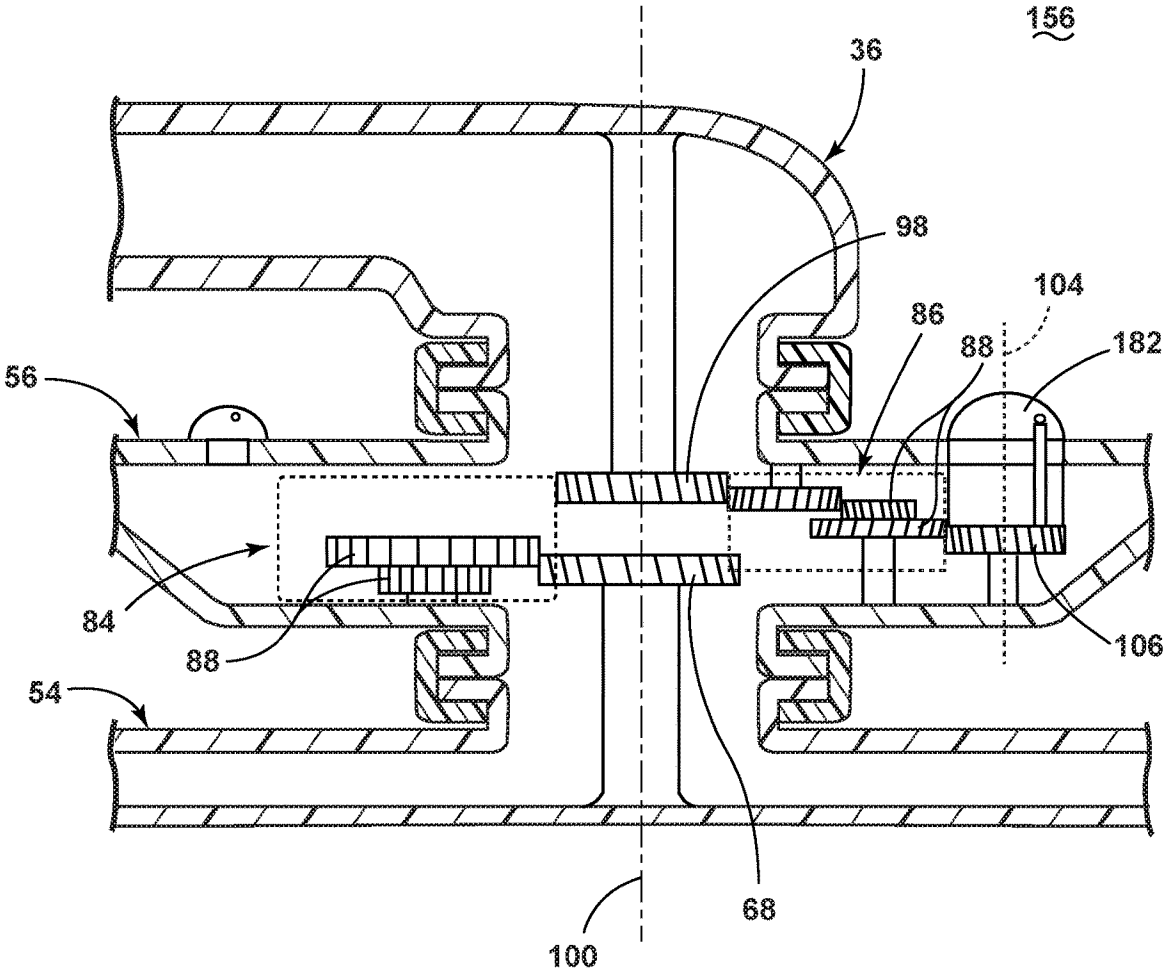
FIG. 5 is a cross-sectional view of a second embodiment of a second rotatable spray arm, which can be used in the dishwasher of FIG. 1.

FIG. 5 illustrates an alternative configuration of the second rotatable spray arm 156 according to a second embodiment of the invention. The second embodiment is similar to the first embodiment; therefore, like parts will be identified with like numerals increased by 100, with it being understood that the description of the like parts of the first embodiment applies to the second embodiment, unless otherwise noted. A difference between the first embodiment and the second embodiment is that the second rotatable spray arm 156 can include at least one spray nozzle 182 having a nozzle gear 106 configured to rotate about a second axis of rotation 104 relative to the spray arm 156, and meshing with, for example, the tertiary gear set 86. In this alternative configuration, as the second rotatable spray arm 56 rotates about the axis of rotation 100, a gear drive operates to rotate the nozzle gear 106, and consequently, the spray nozzle 182 about the second axis of rotation 104 to provide an alternative spray pattern. While the nozzle gear 106 is illustrated enmeshing with the tertiary gear set 86, alternative embodiments can include enmeshing with a gear 88 of the secondary gear set 84, or directly enmeshing with at least one of the primary gear 68 or stationary gear 98.

Many other possible embodiments and configurations in addition to that shown in the above figures are contemplated by the present disclosure. For example, one embodiment of the invention contemplates including a first and second rotatable spray arm on the upper sprayer system 30 or the lower spray system 34. Additionally, relative placement of the first rotatable spray arm, second rotatable spray arm, and spray arm manifold can be adjusted based on the relative location of the spray system in the dishwasher. For example, in a configuration wherein the upper spray system 30 includes a first and second rotatable spray arm, the manifold can be configured proximate to the top of the dishwasher, adjacent to the first rotatable spray arm, which is further adjacent to the second rotatable spray arm, on the opposite side of the manifold. Additionally, the configuration of the drive nozzles and spray nozzles can be adjusted to locate or expose liquid to the articles or dishes for treating. For instance, in the aforementioned example wherein the upper sprayer system 30 includes a first and second rotatable spray arm, the spray nozzles can be configured to spray liquid downward into the treating chamber.

In another configuration of embodiments of the disclosure, the first and second rotatable spray arms can be configured, for example, by way of the gear drive, to rotate in the same or opposing rotational directions. Additionally, the design and placement of the various components such as valves, pumps, or conduits can be rearranged such that a number of different in-line configurations could be realized.

The embodiments disclosed herein provide a spray arm assembly for a dishwasher or appliance having a first rotating spray arm coupled with a second rotating spray arm by a gear drive, wherein the rotation of the first arm drives the rotation of the second arm. For example, the embodiments described above allow for additional coverage of the treating chamber with multiple spray nozzles and spray patterns, which can be used during a cycle of operation. The use of multiple spray nozzles and spray patterns can in turn results in better cleaning of articles or dishes within the treating chamber with no additional liquid consumption.

Another advantage of embodiments of the disclosure can provide a rotatable spray arm driven by the flow of liquid provided to the sprayer system. Such a configuration can eliminate the need for alternative driving mechanisms, motors, or the like, allowing for simpler design and construction. Yet another advantage can include that the drive nozzles and spray nozzles can be configured to operate effectively at a predetermined or known liquid pressure or liquid supply provided by the pump. Yet another advantage can include selecting an appropriate gear ratio to allow for the driving first rotatable spray arm to rotate at a speed relative to the second rotatable spray arm. Better cleaning or tall articles, such as glasses can be further effected by increasing the dwell time of the wash spray on, at, or within the article. By slowing the rotational speed of the second rotatable spray arm by way of the speed-reducing gear drive, the dwell time of the wash liquid can increase, while driving first rotatable spray arm continues rotating at a higher speed, which reduces the risk of stalling or stopping the arms.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" various elements have been described, it will be understood that "a set" can include any number of the respective elements, including only one element. Combinations or permutations of features described herein are covered by this disclosure.

This written description uses examples to disclose embodiments of the invention, including the best mode, and also to enable any person skilled in the art to practice embodiments of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dish treating appliance comprising:

a tub having an access opening and at least partially defining a dish treating chamber;

a first rotating spray arm having multiple drive nozzles and a first supply conduit fluidly coupled to the multiple drive nozzles;

a second rotating spray arm having multiple spray nozzles and a second supply conduit fluidly coupled to the multiple spray nozzles;

a manifold supplying liquid to the first and second supply conduits; and a gear drive rotationally coupling the first and second rotating spray arms such that rotation of the first rotating spray arm rotates the second rotating spray arm, and comprising:

a primary drive gear fixedly mounted within the first supply conduit;

a secondary drive gear fixedly mounted within the second supply conduit; and a gear set enmeshed between the primary and secondary drive gears;

wherein the supply of liquid from the manifold to the first and second supply conduits causes liquid to be emitted from the multiple spray nozzles into the dish treating chamber and liquid to be emitted from the drive nozzles to rotate the first rotating spray arm, which drives the gear drive to rotate the second rotating spray arm.

2. The dish treating appliance of claim 1 wherein the gear drive comprises a gear reduction such that second rotating spray arm rotates more slowly than the first rotating spray arm.

3. The dish treating appliance of claim 2 wherein the first rotating spray arm rotates at least at 15 RPM in response to the supply of liquid from the manifold at 20 to 60 liters per minute.

4. The dish treating appliance of claim 3 wherein the second rotating spray arm rotates less than 7 rpm.

5. The dish treating appliance of claim 1 wherein the first and second rotating spray arms are arranged in a stacked configuration.

6. The dish treating appliance of claim 5 wherein the first and second rotating spray arms share a common axis of rotation.

7. The dish treating appliance of claim 6 wherein the first and second rotating spray arms are directly rotationally mounted to each other.

8. The dish treating appliance of claim 1 wherein the gear set is a reducing gear set.

9. The dish treating appliance of claim 1 wherein the gear drive further comprises a reaction gear fixedly mounted within the manifold and enmeshed with the secondary drive gear.

10. The dish treating appliance of claim 1 wherein the second rotating spray arm has no drive nozzles.

11. The dish treating appliance of claim 1 wherein the first rotating spray arm rotates faster than the second rotating spray arm.

12. The dish treating appliance of claim 1 wherein the first rotating spray arm is closer to a bottom of the tub than the second rotating spray arm.

13. A spray arm assembly comprising:

a first rotating spray arm having multiple drive nozzles and a first supply conduit fluidly coupled to the multiple drive nozzles;

a second rotating spray arm having multiple spray nozzles and a second supply conduit fluidly coupled to the multiple spray nozzles wherein at least one of the multiple spray nozzles is a rotatable spray nozzle;

a manifold supplying liquid to the first and second supply conduits; and a gear drive rotationally coupling the first and second rotating spray arms such that rotation of the second rotating spray arm rotates the first rotating spray arm and the at least one rotatable spray nozzle relative to the second rotating spray arm;

wherein the supply of liquid from the manifold to the first and second supply conduits causes liquid to be emitted from the multiple spray nozzles and liquid to be emitted from the drive nozzles to rotate the second rotating spray arm, which drives the gear drive to rotate the first rotating spray arm.

14. The spray arm assembly of claim 13, wherein the gear drive comprises a gear reduction such that first rotating spray arm rotates more slowly than the second rotating spray arm.

15. The spray arm assembly of claim 14 wherein the second rotating spray arm rotates at least at 15 RPM in response to the supply of liquid from the manifold at 20 to 60 liters per minute.

16. The spray arm assembly of claim 13 wherein the second rotating spray arm rotates less than 7 rpm.

17. A spray arm assembly for an appliance performing a cycle of operation on an article, comprising:

a manifold supported by the appliance and configured to provide a supply of liquid;

a first spray arm rotatably coupled with the manifold and having a drive nozzle, a first supply conduit, and a first gear at least partially located within the first supply conduit, wherein the first spray arm is configured to receive at least a first portion of the liquid in the first supply conduit and provide at least the first portion of the liquid to the drive nozzle; and a second spray arm rotatably coupled with the manifold and having a set of spray heads, a second supply conduit, and a second gear at least partially located within the second supply conduit, wherein the second spray arm is configured to receive at least a second portion of the liquid in the second supply conduit, provide at least the second portion of the liquid to the set of spray heads, and wherein a gear set is enmeshed between the second gear and the first gear to mechanically couple the first gear and the second gear;

wherein the providing of the first portion of the liquid through the drive nozzle drives a rotation of the first spray arm, and the rotation of the first spray arm drives the rotation of the second spray arm by way of the first gear and the second gear.

* * * * *